US008087172B2

(12) United States Patent
Farris et al.

(10) Patent No.: US 8,087,172 B2
(45) Date of Patent: Jan. 3, 2012

(54) METHOD AND APPARATUS FOR EXTENDED LIFE JOURNAL ASSEMBLY

(75) Inventors: Lawrence S. Farris, East Granby, CT (US); Mark Andrew Fuller, Canton, CT (US)

(73) Assignee: Alstom Technology Ltd. (CH)

( * ) Notice: Subject to any disclaimer, the term of this patent is extended or adjusted under 35 U.S.C. 154(b) by 602 days.

(21) Appl. No.: 12/239,030

(22) Filed: Sep. 26, 2008

(65) Prior Publication Data

US 2010/0077616 A1 Apr. 1, 2010

(51) Int. Cl.
*B02C 15/04* (2006.01)

(52) U.S. Cl. ..... 29/898.07; 241/121; 241/101.2; 29/898.01; 29/898.062; 29/898.041; 384/477

(58) Field of Classification Search ..... 29/898.01, 29/898.11, 401.1, 402.01, 402.02, 402.03, 29/402.08, 447; 384/559, 571, 584, 585, 384/586; 241/121, 24.31
See application file for complete search history.

(56) References Cited

U.S. PATENT DOCUMENTS 2,415,324 A * 2/1947 Wilson ..... 29/898.01
2,532,092 A * 11/1950 Frangquist ..... 241/293
2,587,405 A * 2/1952 Stevens et al. ..... 277/572
3,376,630 A * 4/1968 Lempka ..... 29/402.11
3,465,971 A 9/1969 Dalenberg et al.
4,002,299 A 1/1977 Skalka
4,050,140 A * 9/1977 Newell ..... 29/898.01
4,234,132 A 11/1980 Maliszewski, Jr.
4,529,136 A * 7/1985 Gelbar ..... 241/79
4,538,768 A * 9/1985 Paskowski et al. ..... 241/101.2
4,703,690 A 11/1987 Prairie et al.
4,706,900 A 11/1987 Prairie et al.
4,759,509 A 7/1988 Prairie
5,452,504 A * 9/1995 Tatro et al. ..... 29/597
6,061,908 A 5/2000 DeMarey et al.
6,484,403 B1 * 11/2002 Macklin et al. ..... 29/898.01
6,564,727 B1 5/2003 Kmiotek et al.
7,267,293 B2 9/2007 Chen et al.

OTHER PUBLICATIONS

Maintenance Fundamentals, R. Keith Mobley, Copyright 2004, Elsevier Butterworth Heinmann, 2nd Edition, pp. 159-160.*

* cited by examiner

*Primary Examiner* — David Bryant
*Assistant Examiner* — Jason L Vaughan
(74) *Attorney, Agent, or Firm* — Cantor Colburn LLP

(57) ABSTRACT

A method of extending the life of a journal bearing assembly in a solid fuel pulverizer includes: removing a first lower journal bearing from a journal shaft and a lower bearing seat of a lower bearing housing; removing a first upper journal bearing from the shaft and an upper bearing seat of an upper bearing housing; modifying the lower and upper bearing seats; modifying lower and upper shoulders on the journal shaft; disposing the second lower and upper journal bearings on the modified lower and upper bearing seats; disposing a new journal bearing spacer between the second lower and upper journal bearings; disposing a new journal bearing collar between the upper shoulder and the second upper journal bearing; filling a cavity defined by the lower and upper journal housings with grease; and disposing a seal assembly between the shaft and one end of the upper journal housing opposite the lower journal housing to prevent the ingress of solid fuel into the cavity of the journal assembly.

11 Claims, 5 Drawing Sheets

DETAIL A

DETAIL B

METHOD AND APPARATUS FOR EXTENDED LIFE JOURNAL ASSEMBLY

TECHNICAL FIELD

The present invention relates to a journal assembly for pulverizing a solid fuel, and more particularly, to an improved journal assembly which accommodates larger capacity tapered roller bearings while maintaining an existing journal assembly envelope for a mill for pulverizing a solid fuel, such as coal, for example, in a new utility unit application or a retrofit application in an existing utility unit.

BACKGROUND

Pulverizers are well known for the reduction of the particle size of solid fuel to allow for combustion of the solid fuel in a furnace. A pulverizer employs some combination of impact, attrition and crushing to reduce a solid fuel to a particular particle size. Several types of pulverizer mills can be employed for the pulverization of the solid fuel, for example, coal, to a particulate size appropriate for firing in a furnace. These can include ball-tube mills, impact mills, attrition mills, ball race mills, and ring roll or bowl mills. Most typically, however, bowl mills with integral classification equipment are employed for the pulverization of the solid fuel to allow for transport, drying and direct firing of the pulverized fuel entrained in an air stream.

Bowl mills have a grinding ring carried by a rotating bowl. Fixed position rollers are mounted on roller journal assemblies such that the roll face of the rollers are approximately parallel to the inside surface of the grinding ring and define a very small gap therebetween. Pressure for grinding is applied through springs or hydraulic cylinders on the roller journal to crush solid fuel caught between the roll face of the roller and the grinding ring.

An air stream is typically utilized for drying, classification, and transport of the solid fuel through the pulverizer. The air stream employed is typically a portion of the combustion air referred to as the primary air. The primary air is combustion air first directed through a preheater whereby the combustion air is heated with energy recovered from the flue gas of the furnace. A portion of the primary air is then ducted to the pulverizers. In a bowl mill, the primary air is drawn through beneath the bowl of the bowl mill and up past the roller journal assemblies to collect the pulverized solid fuel. The small particles of solid fuel become entrained in the primary air. The air stream containing the solid fuel then passes through a classifier into the outlet of the pulverizer. After passing through the exhauster, the pulverized fuel can be stored, or more typically, is transported to the furnace by the air stream for direct firing.

The journal loading, which dictates the amount of grinding force that the grinding rolls exert on the coal, to crush solid fuel caught between the roll face of the roller and the grinding ring, has been provided to date either through the use of hydraulic systems or through the use of mechanical springs. One such arrangement of mechanical springs can be found depicted, for example, in U.S. Pat. No. 4,706,900 entitled "Retrofitable Coiled Spring System," which issued on Nov. 17, 1987 and which is assigned to the same assignee as the present invention. In accord with a showing contained in this U.S. patent, each grinding roll is urged towards the surface of the grinding table by means of an adjustable spring and is rotated about a fixed shaft within the journal assembly and connected to the rotatable grinding roll. To this end, journal bearings allow rotation of the journal assembly relative to the shaft and a spring capable of urging the grinding roll toward the grinding table surface. The spring exerts a predetermined grinding force on the coal disposed on the table when the coal is of a predetermined depth on the table.

Although the journal bearings used in mill of U.S. Pat. No. 4,706,900 have demonstrated to be operative for the purpose for which they have been designed, a need still exists to improve the mill loading and roll life of the bearings. More specifically, the original roll life goal for the journal bearings was 50,000 hours which translated into a roll life of only one or two years using Ni-Hard. However, today mill loading and roll life demand has increased, with projections/demand extending to 82 months (6.8 years) in some instances. Thus, there is a need for longer bearing lives across older, as well as newer, mill lines.

Another factor which deteriorates roll life of the bearings in addition to increased mill loading includes solid fuel dust, such as coal dust, for example, which flows into the journal assembly and contaminates the bearings and lubricant therefor. An interface between the rotatable journal assembly and stationary shaft is exposed to atmospheric conditions and a differential pressure across the journal assembly allows the coal dust, for example, to flow into the journal assembly housing the bearings. The ingress of coal at this interface, which allows the shaft to extend therethrough and rotate with respect to the journal assembly, contaminates the lubricant and journal bearings thus deteriorating the roll life of the journal bearings.

Therefore, there remains a need for a method and apparatus for increasing bearing roll life in a journal assembly, which facilitates increased mill loading and prevents contamination of the bearings, while using as much of the existing journal assembly envelope to reduce costs.

SUMMARY

According to the aspects illustrated herein, there is provided a method of extending the life of a journal bearing assembly in a solid fuel pulverizer. The method includes: removing a first lower journal bearing from a journal shaft and a lower bearing seat of a lower bearing housing configured to support a grinding roll in the pulverizer; removing a first upper journal bearing from the shaft and an upper bearing seat of an upper bearing housing configured to be coupled to the lower bearing housing; modifying the lower and upper bearing seats to provide modified lower and upper bearing seats; modifying bearing seats in lower and upper bearing housings defining the journal assembly to receive the larger capacity lower and upper journal bearings; modifying lower and upper shoulders on the journal shaft to receive the larger capacity second lower and upper journal bearings, respectively, while retaining an original diameter of the journal shaft under the second larger capacity lower and upper journal bearings; disposing the second lower and upper journal bearings on the modified lower and upper bearing seats, the second lower and upper journal bearings having at least one of an increased diameter and width than the first lower and upper journal bearings; disposing a new journal bearing spacer between the second lower and upper journal bearings; disposing a new journal bearing collar between the upper shoulder and the second upper journal bearing; filling a cavity defined by the lower and upper journal housings with grease; and disposing a seal assembly between the shaft and one end of the upper journal housing opposite the lower journal housing to prevent the ingress of solid fuel into the cavity of the journal assembly.

The above described and other features are exemplified by the following figures and detailed description.

BRIEF DESCRIPTION OF THE DRAWINGS

Referring now to the figures, which are exemplary embodiments, and wherein the like elements are numbered alike.

DETAILED DESCRIPTION

Figure 1:
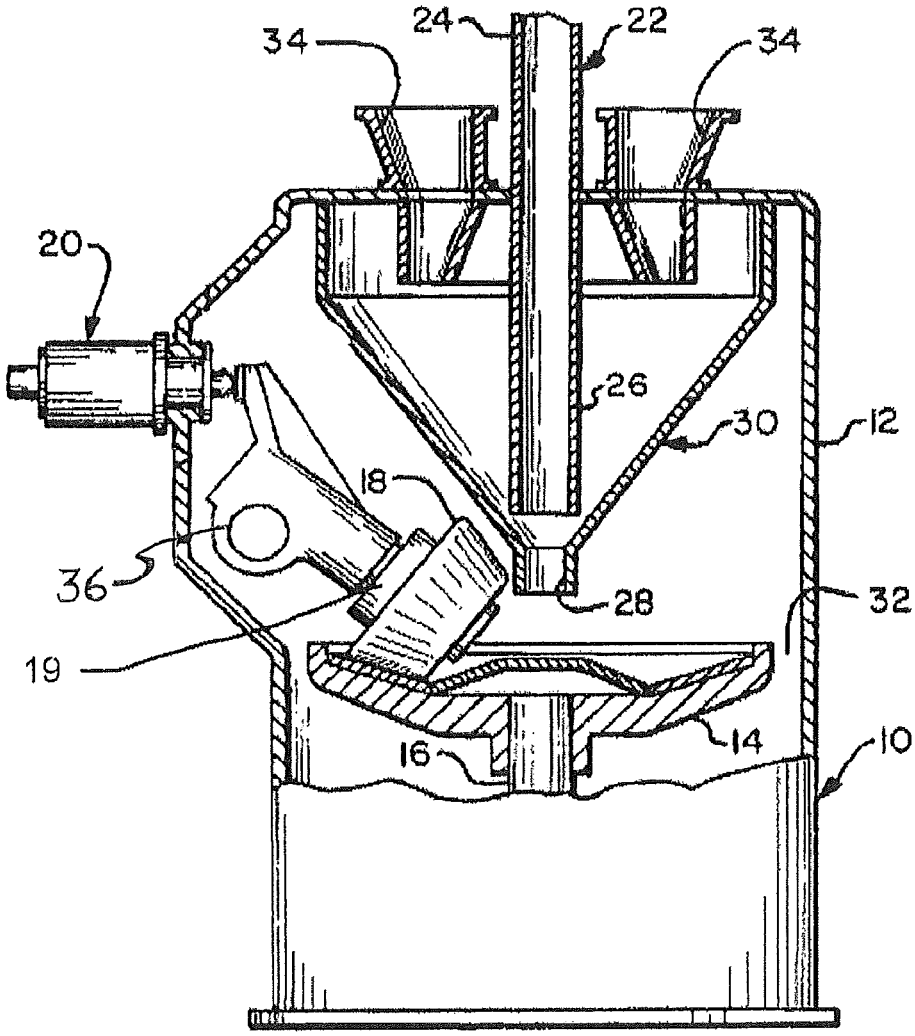
Fig. 1 (Prior Art)
FIG. 1 is a side elevational view partially in section of a pulverizer bowl mill equipped with a journal assembly constructed in accordance with the prior art.

Referring now to the drawings, and more particularly to FIG. 1, a pulverizing bowl mill 10 constructed in accordance with the prior art is illustrated. As the nature of the construction and the mode of operation of pulverizing bowl mills are well-known to those skilled in the art, it is not deemed necessary, therefore, to set forth herein a detailed description of the pulverizing bowl mill 10 illustrated in FIG. 1 of the drawing. Rather, it is deemed sufficient for purposes of obtaining an understanding of a pulverizing bowl mill 10, which is equipped with a journal assembly constructed in accordance with the present invention, that merely a description of the nature of the construction and the mode of operation of the components of the pulverizing bowl mill 10 with which the journal assembly cooperates. For a more detailed description of the nature of the construction and the mode of operation of the components of the pulverizing bowl mill 10, which are not described in detail herein, reference is made to the prior art, e.g., U.S. Pat. No. 3,465,971, which issued on Sep. 9, 1969 to J. F. Dalenberg et al., and/or U.S. Pat. No. 4,002,299, which issued on Jan. 11, 1977 to C. J. Skalka.

Still referring to FIG. 1, the pulverizing bowl mill 10 includes a substantially closed separator body 12. A grinding table 14 is mounted on a shaft 16, which in turn is operatively connected to a suitable drive mechanism (not shown) so as to be capable of being suitably driven thereby. With the aforesaid components arranged within the separator body 12 in the manner depicted in FIG. 1 of the drawing, the grinding table 14 is designed to be driven in a clockwise direction.

A plurality of grinding rolls 18, preferably three in number in accord with conventional practice, are suitably supported within the interior of the separator body 12 so as to be equidistantly spaced one from another around the circumference of the separator body 12. In the interest of maintaining clarity of illustration in the drawing, only one grinding roll 18 is shown in FIG. 1. Each of the grinding rolls 18 is supported on a suitable shaft (not shown) of a journal assembly 19 for rotation relative thereto. The grinding rolls 18 are each suitably supported in a manner for movement relative to the upper surface, as viewed with reference to FIG. 1, of the grinding table 14. To this end, each of the grinding rolls 18 has a biasing system 20, e.g., a mechanical coiled spring system 20, cooperatively associated therewith via the journal assembly 19. Each of the mechanical coiled spring systems 20 is operative to establish a mechanical spring loading on the corresponding grinding roll 18 to exert the requisite degree of force on the solid fuel disposed on the grinding table 14 for the desired purpose of pulverizing the solid fuel.

The solid fuel material, e.g., coal, which is pulverized in the bowl mill 10 is fed thereto through the use of any suitable conventional type of feeding means such as a belt feeder (not shown). Upon falling free of the belt feeder (not shown), the coal enters the bowl mill 10 from a coal supply means, generally designated by reference numeral 22. The coal supply means 22 includes a suitably dimensioned duct 24 having one end thereof which extends outwardly of the separator body 12 and preferably terminates in a funnel-like member (not shown). The latter funnel-like member (not shown) is shaped to facilitate the collection of the coal particles leaving the belt feeder (not shown), and to guide the coal particles into the duct 24. The other end 26 of the duct 24 of the coal supply means 22 is operative to effect the discharge of the coal onto the surface of the grinding table 14. As shown in FIG. 1, the duct end 26 is supported within the separator body 12 such that the duct end 26 is coaxially aligned with the shaft 16, and is located in spaced relation to an outlet 28 provided in a classifier 30, through which the coal flows in the course of being fed onto the surface of the grinding table 14.

A gas such as air is used to convey the finer ground coal from the grinding table 14 through the interior of the separator body 12 for discharge from the pulverizing bowl mill 10. The air enters the separator body 12 through a suitable opening (not shown) provided therein for this purpose. The air flows to a plurality of annular spaces 32 from the aforesaid opening (not shown) in the separator body 12. The plurality of annular spaces 32 are formed between the circumference of the grinding table 14 and the inner wall surface of the separator body 12. The air upon exiting from the annular spaces 32 is deflected over the grinding table 14 by means of suitably positioned deflector means (not shown). One such form of deflector means (not shown), which is suitable for this purpose in the bowl mill 10 of FIG. 1, comprises the subject matter of U.S. Pat. No. 4,234,132, which issued on Nov. 18, 1980 to T. V. Maliszewski, Jr., and which is assigned to the same assignee as the present application.

While the air is flowing along the path described above, the coal disposed on the surface of the grinding table 14 is pulverized by the grinding rolls 18. As the coal becomes pulverized, the particles are thrown outwardly by centrifugal force away from the center of the grinding table 14. Upon reaching the peripheral circumferential area of the grinding table 14, the coal particles are picked up by the air exiting from the annular spaces 32 and are carried along therewith. The combined flow of air and coal particles is thereafter captured by the deflector means (not shown). The deflector means causes the combined flow of air and coal particles to be deflected over the grinding table 14. In the course of effecting a change in direction in the path of flow of this combined stream of air and coal particles to be deflected over the grinding table 14, the heaviest coal particles, because they have more inertia, become separated from the airstream and fall back onto the grinding table 14 whereupon they undergo further pulverization. The lighter coal particles, on the other hand, because they have less inertia continue to be carried along in the airstream.

After leaving the influence of the aforesaid deflector means (not shown) the combined stream of air and remaining coal particles flow to the classifier 30. The classifier 30, in accord with conventional practice and well-known to those skilled in the art, further sorts the coal particles that remain in the airstream. Namely, those particles of pulverized coal, which are of the desired particle size, pass through the classifier 30 and along with the air are discharged from the bowl mill 10 through the outlets 34. However, the coal particles having a size larger than desired are returned to the surface of the grinding table 14 whereupon they undergo further pulverization. Thereafter, these coal particles are subject to repetition of the process described above. That is, the particles are thrown radially outwardly of the grinding table 14, are picked up by the air exiting from the annular spaces 32, are carried along with the air to the deflector means (not shown), are deflected back over the grinding table 14 by the deflector means (not shown), the heavier particles drop back on the grinding table 14, the lighter particles are carried along to the classifier 30, those particles which are of the proper size pass through the classifier 30 and exit from the bowl mill 10 through the outlets 34.

The amount of force that must be exerted by the grinding rolls 18 in order to effect the desired degree of pulverization of the coal will vary depending on a number of factors. In other words, the amount of force that the grinding rolls 18 must exert in order to accomplish the desired pulverization of the coal is principally a function of the amount, e.g., depth, of coal present on the grinding table 14. In turn, the amount of coal which is disposed on the grinding table 14 is a function of the output rate at which the bowl mill 10 is being operated to produce pulverized coal.

The amount of grinding force which the grinding rolls 18 apply to the coal on the grinding table 14 is a function of the amount of force with which the grinding rolls 18 are biased into engagement with the coal on the table 14 via the biasing system 20. The grinding roll 18 is supported so as to be pivotable about a pivot pin 36 into and out of engagement with the coal disposed on the grinding table 14. Although only one grinding roll 18 is shown in FIG. 1 and although this discussion is directed to one grinding roll 18, it is to be understood that the bowl mill 10 commonly is provided with a plurality of grinding rolls 18, e.g., preferably three in number, and that this discussion is equally applicable to each of the plurality of grinding rolls 18.

The grinding roll 18 is designed to be biased by a force into and out of engagement with the coal on the grinding table 14. More specifically, the force applied to the grinding roll 18 is a spring force applied by the mechanical coiled spring system 20, which produces an axial force applied to the grinding roll 18.

Figure 2:
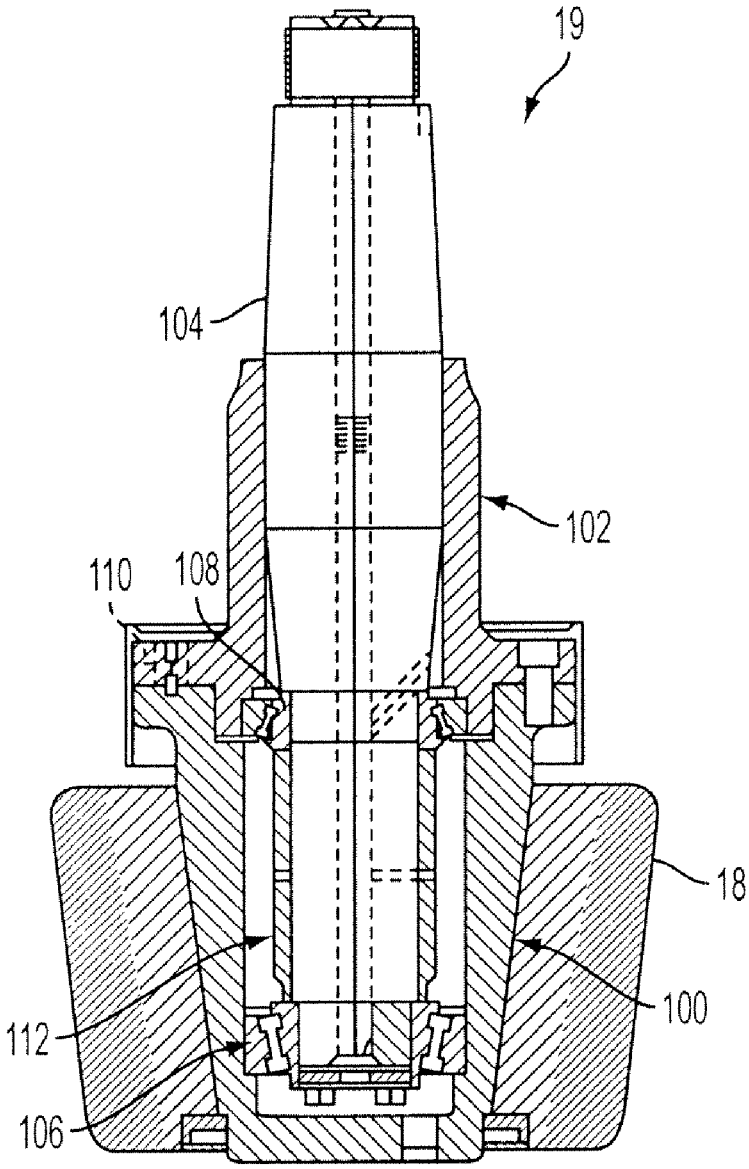
FIG. 2 PRIOR ART
FIG. 2 is an enlarged cross-sectional view of the journal assembly of the pulverizer bowl mill of FIG. 1 constructed in accordance with the prior art.

FIG. 2 illustrates an enlarged cross-sectional view of the journal assembly 19 removed from the pulverizer bowl mill 10 of FIG. 1 constructed in accordance with the prior art. The journal assembly 19 includes grinding roll 18 coupled to a lower journal housing 100, which in turn is coupled to an upper journal housing 102. The lower and upper journal housings 100, 102 receive a shaft 104 therethrough via a lower journal bearing 106 and an upper journal bearing 108 disposed at the lower and upper journal housings 100, 102, respectively. An upper journal housing cover 110 covers mounting flanges of the respective lower and upper journal housings 100, 102. A bearing spacer 112 spaces the lower and upper journal bearings 106, 108 apart from one another in a bath of oil (not shown) to lubricate the journal bearings 106, 108 housed in the lower and upper journal housings 100, 102, respectively. However, as discussed above, there is a desire to increase the roll life of the journal bearings and prevent ingress of coal contamination into the oil lubricant and journal bearings.

Figure 3:
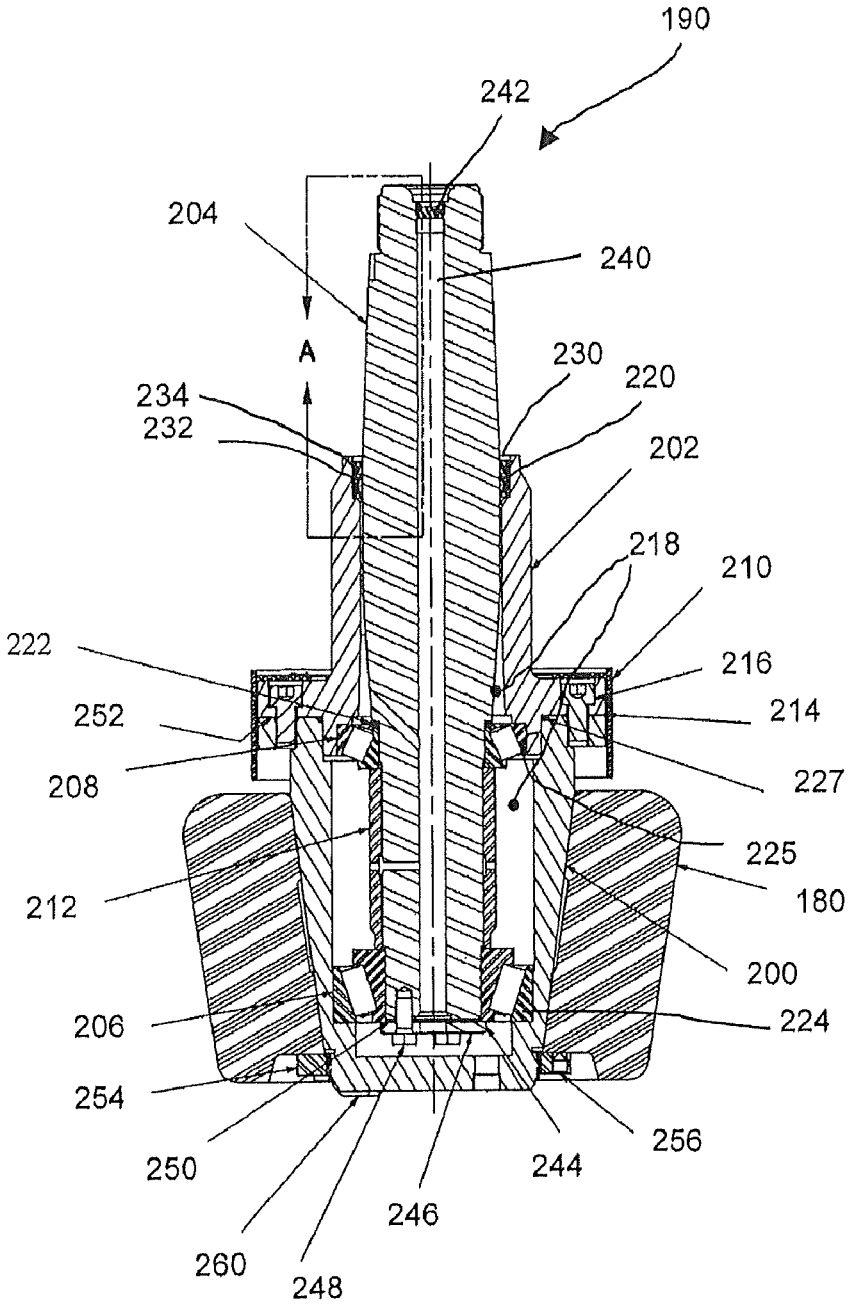
FIG. 3 is a cross-sectional view of a journal assembly accommodating larger capacity bearings in accordance with an exemplary embodiment of the present invention.
Figure 4:
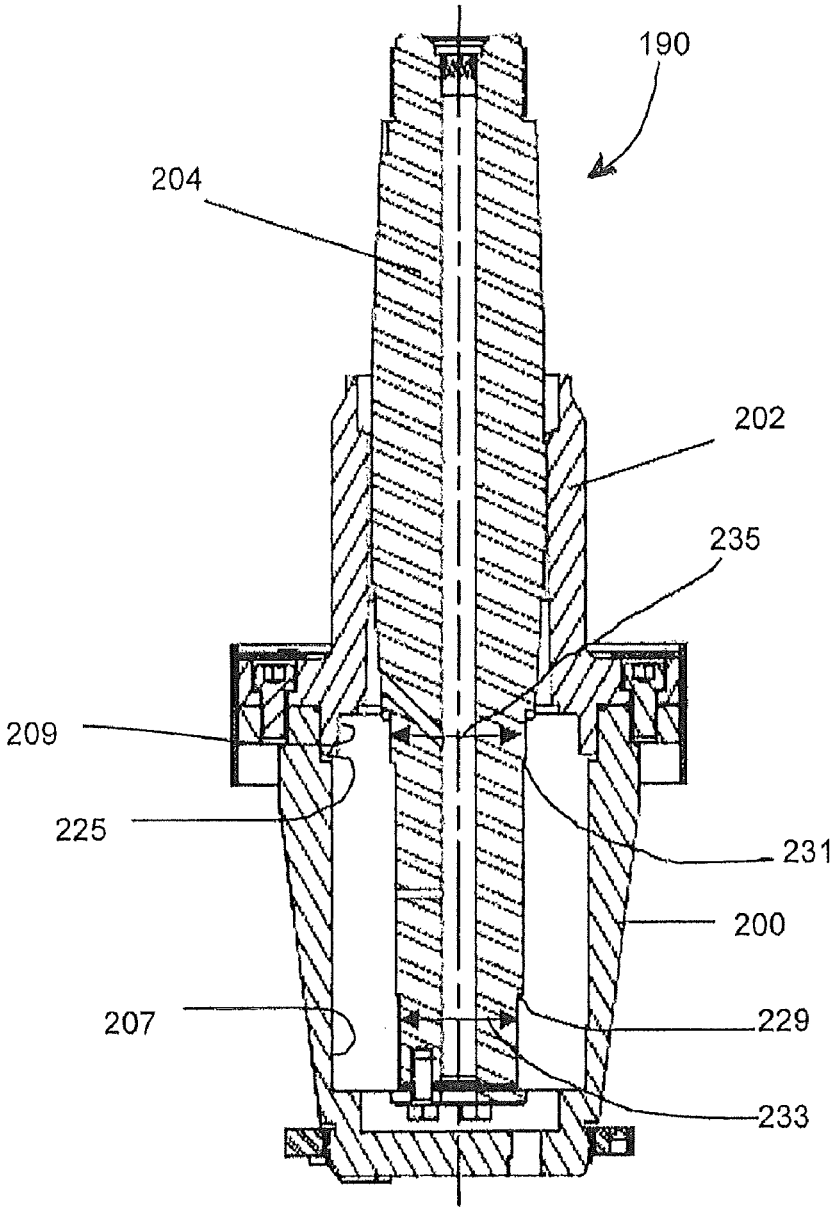
FIG. 4 is an enlarged cross-sectional view of the journal assembly of FIG. 3 with a seal assembly and the bearings removed.

To this end, the bowl mill 10 embodies a plurality of new and improved journal assemblies 190, as partially illustrated in FIGS. 3 and 4. That is, in accord with the best mode embodiment of the present invention each of the three grinding rolls 18 with which the bowl mill 10 is provided has cooperatively associated therewith a new and improved journal assembly 190. However, inasmuch as the three journal assemblies 190 are each identical in construction and in mode of operation, it has been deemed sufficient for purposes of obtaining an understanding thereof as well as in the interest of maintaining clarity of illustration in the drawing to show only one of the three journal assemblies 190 in FIGS. 3 and 4.

Turning now to consideration in further detail of the nature of the construction of the exemplary journal assembly 190, general reference will be made first to FIG. 3 for this purpose in describing the journal assembly 190. As depicted therein, the journal assembly 190, akin to the journal assembly 19 of FIG. 2, includes the following major components: a grinding roll 180 coupled to a lower journal housing 200, which in turn is coupled to an upper journal housing 202. The lower and upper journal housings 200, 202 receive a shaft 204 therethrough via a lower journal bearing 206 and an upper journal bearing 208 disposed at the lower and upper journal housings 200, 202, respectively. An upper journal housing cover 210 covers mounting flanges 214, 216 of the respective lower and upper journal housings 200, 202. A bearing spacer 212 spaces the lower and upper journal bearings 206, 208 apart from one another housed in a cavity 218 defined by the lower and upper journal housings 200, 202, respectively. In addition, the journal assembly 190 includes a seal assembly 220 disposed at an interface between the upper journal housing 202 and the shaft 204. The seal assembly 220 prevents ingress of solid fuel, e.g., coal, into the cavity 218, thus preventing contamination of the journal bearings 206, 208 and grease lubricant therefor (not shown) in the cavity 218.

Still referring to FIG. 3, the journal assembly 190 will be discussed in more detail. In order to increase the roll life of the journal bearings 206, 208 in journal assembly 190 over that of the journal bearings 106, 108 in the conventional journal assembly 19 of FIG. 2, bearings 206, 208 are larger capacity tapered roller bearings 206, 208 than bearings 106, 108. For example, the original upper journal bearing 108 employed in the journal assembly 19 of FIG. 2 may be configured as follows, but not limited thereto: Bore=5.0000 inches, outside diameter (OD)=8.5000 inches, Width=1.875 inches, Dynamic Radial Capacity=20,600 lbs., Dynamic Thrust Capacity=17,200 lbs. The original lower journal bearing 106 employed in the journal assembly 19 may be configured as follows, but not limited thereto: Bore=4.5000 inches, OD=8.3750 inches, Width=2.6250 inches, Dynamic Radial Capacity=36,700 lbs., Dynamic Thrust Capacity=20,500 lbs. In contrast, the new upper journal bearing 208 employed in the journal assembly 190 of FIG. 3 may be configured as follows, but not limited thereto: Bore=5.0000 inches, OD=9.0000 inches, Width=2.1250 inches, Dynamic Radial Capacity=26,700 lbs., Dynamic Thrust Capacity=33,700 lbs. Likewise, the new lower journal bearing 206 employed in the journal assembly 190 may be configured, as follows, but not limited thereto: Bore=4.5000 inches, OD=9.5000 inches, Width=3.5000 inches, Dynamic Radial Capacity=50,400 lbs., Dynamic Thrust Capacity=36,200 lbs. The above information is represented in Table 1 below:

TABLE 1

| | Bore (inches) | OD (inches) | Width (inches) | Dynamic Radial Capacity (pounds) | Dynamic Thrust Capacity (pounds) |
|---|---|---|---|---|---|
| Original Upper Bearing 108 | 5.0000 in. | 8.5000 in. | 1.875 in. | 20,600 lbs. | 17,200 lbs. |
| New Upper Bearing 208 | 5.0000 in. | 9.0000 in. | 2.1250 in. | 26,700 lbs. | 33,700 lbs. |
| Original Lower Bearing 106 | 4.5000 in. | 8.3750 in. | 2.6250 in. | 36,700 lbs. | 20,500 lbs. |
| New Lower Bearing 206 | 4.5000 in. | 9.5000 in. | 3.5000 in. | 50,400 lbs. | 36,200 lbs. |

Therefore, a ratio of new/original Dynamic Radial Capacities shows a calculated increase in L10 bearing life of over 2.5 times. Thus, reference to larger "capacity" with respect to journal bearings 206 and 208 means the increased dynamic radial capacity which translates into an increased L10 bearing life over the original journal bearings 106 and 108. In particular, the dynamic radial capacity increases at least 25% for both the new upper and lower tapered roller bearings 206, 208. In exemplary embodiments and from Table 1 above, it can been seen that the dynamic radial capacity of the upper tapered roller bearing 208 increases about 29.61%, while the dynamic radial capacity of the lower tapered roller bearing 206 increases about 37.33%. The larger capacity tapered roller bearings 206, 208 are also lubricated with grease instead of oil and the seal assembly 220 prevents contamination of the grease lubricant and journal assembly tapered roller bearings 206, 208. Furthermore, the use of the seal assembly 220 allowing the use of grease, rather than oil, to lubricate the bearings 206, 208 has also been discovered to increase bearing life.

However, with the goal of using larger capacity tapered roller bearings 206, 208 to increase roll life between journal assembly rebuilds, it is also desired to maintain an existing journal assembly envelope. In order to accommodate larger capacity tapered roller bearings 206, 208 in the exemplary journal assembly 190 without changing the outside boundary dimensions thereof, it will be recognized by those skilled in the pertinent art that respective bearing seats 207, 209 (FIG. 4) of the lower and upper journal housings 200, 202, as well as the shaft 204, are modified to accommodate the increased outside diameter and width (elevation height as illustrated) of the larger capacity tapered roller bearings 206, 208. Because of the wider roller bearings 206, 208, the bearing spacer 212 is a new part, which replaces the bearing spacer 112 in FIG. 2. In addition, a new journal bearing collar 222 is incorporated having dimensions corresponding to the new bearing width of bearing 208.

Since the bearings 206, 208 in FIG. 3 are wider than bearings 106, 108 in FIG. 2, the shaft 204 is modified to locate shoulders 229, 231 (FIG. 4) thereof corresponding to abutment with inner races of the respective bearings 206, 208. However, a bore diameter of the inner races for each of the tapered roller bearings 206, 208 are selected or designed so that changes to a corresponding diameter 233, 235 (FIG. 4) of the shaft 204 under each bearing 206, 208 are not necessary as illustrated with reference to Table 1 above. In particular, a wider lower bearing seat (illustrated as an increased elevation height in FIG. 4 and opposite the lower bearing seat 207 of the lower journal housing 200) to accommodate the wider, lower journal bearing 206 is reflected by the shoulder 229 in a lower portion of the shaft 204, while retaining a same diameter of the shaft 204.

In addition, the new or modified shaft 204 includes a seal land with an appropriate finish for the seal assembly 220, discussed more fully below with respect to FIGS. 5 and 6. Therefore, minimal change to the shaft 204 is required to accommodate the larger capacity tapered roller bearings 206, 208.

Incorporation of the larger lower tapered roller bearing 206 in the new or modified lower journal housing 200 includes the lower bearing cup seat 207 corresponding to an outer race 224 of the lower bearing 206 to receive the outer race 224 of the lower bearing 206. The lower bearing cup seat 207 is larger in diameter than in the conventional lower journal housing 100. The lower journal housing 200 also includes a housing bore diameter larger than the upper journal housing OD 202 at the diameter generally indicated at 225 of the upper journal housing 202. The upper journal housing OD 202 is configured for installation with an O-ring oil seal 227 disposed between the two diameters 225 and thus between the lower and upper journal housings 200, 202.

Likewise, incorporation of a larger upper tapered roller bearing 208 in the new or modified upper journal housing 202 includes the upper bearing cup seat 209 at one end of the upper journal housing 202 that is both wider and larger in diameter than in the conventional upper journal housing 102. A counter bore 226 and a snap ring groove 228 are configured at an opposite end of the new or modified upper journal housing 202 to receive a snap ring 230 and the seal assembly 220, as best seen with reference to FIG. 6 and discussed more fully below.

Figure 5:
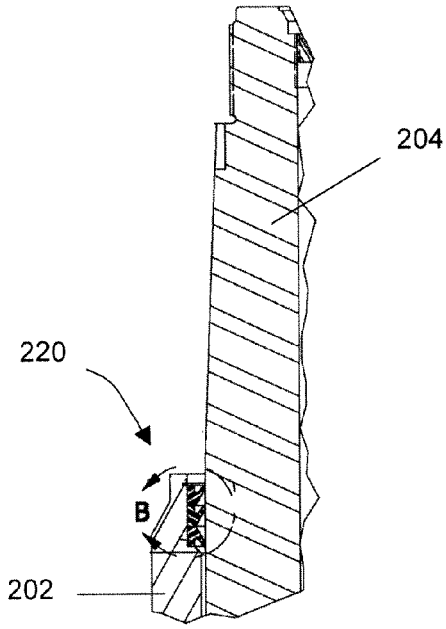
FIG. 5 is an enlarged partial cross-sectional view of detail 'A' in FIG. 3 illustrating an exemplary embodiment of a seal between a shaft and upper journal housing of the exemplary journal assembly in accordance with the present invention.
Figure 6:
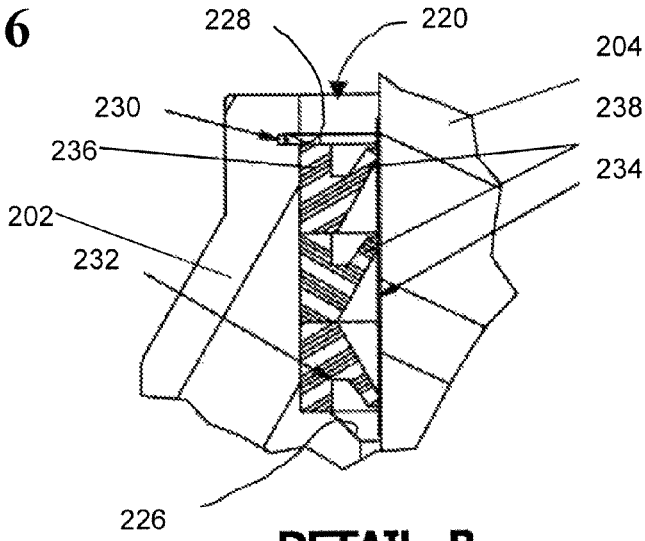
FIG. 6 is an enlarged partial cross-sectional view of detail 'B' in FIG. 5.

Referring now to FIGS. 5 and 6, FIG. 6 is an enlarged partial cross-sectional view of detail 'A' in FIG. 3 illustrating an exemplary embodiment of the seal assembly 220 between the shaft 204 and upper journal housing 202 of the exemplary journal assembly 190 in accordance with the present invention. FIG. 6 is an enlarged partial cross-sectional view of detail 'B' in FIG. 5. The seal assembly 220 includes an oil seal 232 and a wear sleeve 234. The oil seal 232 is disposed in the counterbore 226 and is in sealing communication with the wear sleeve 234 disposed around the shaft 204 aligned with the counterbore 226 on the upper journal housing 202. More specifically, the oil seal 232 comprises a continuous outer ring 236 which abuts the counterbore 226 and a plurality of members 238 extending radially inwardly from the outer ring 236 at an oblique angle from the ring 236 for abutment with the wear sleeve 234. The seal 232 is flexible allowing relative rotational motion of the upper journal housing 202 relative to the stationary shaft 204, while maintaining a positive seal to prevent the ingress of coal. The snap ring 230 is disposed in the snap ring groove 228 to retain the oil seal 232 in the counterbore 226.

Assembly of the journal shaft 204, bearings 206, 208 and upper and lower journal housings 202, 200 is substantially the same as for assembly of the conventional journal assembly 19 with a few differences. These differences primarily include installing the wear sleeve 234 on the shaft 204, packing the seal assembly 220 with grease and installing the seal 232 and retaining ring 230. In addition, as alluded to before, the shaft 204, housings 200, 202 (e.g., cavity 218), tapered roller bearing 206, 208 are filled with grease as a lubricant during the assembly to ensure the final grease fill.

Referring again to FIG. 3, the assembly of journal assembly is described in further detail below. The wear sleeve 234 is heated in an oil bath to a temperature of 250° F. The wear sleeve 234 is a cylindrical hollow sleeve that is then slid into position on the journal shaft 204 and allowed to cool. A shaft bore 240 defined by the shaft 204 is filled with grease prior to installing a pipe plug 242 to seal the shaft bore 240.

The bearing voids of bearings 206, 208 are also packed with grease before final assembly. The lower journal housing 200 defining the cavity 218 is filled approximately ⅔ full of grease. Then the seal 232 is installed into the counterbore 226 of the upper journal housing 202. The remaining cavity 218 defined by the upper journal housing 202 is filled with grease before installing the retaining ring 230 in the groove 228 of the upper journal housing 202.

After the lower journal bearing 206 is installed with the shaft 204, a roller bearing keeper 244 and lock plate 246 are fastened to a bottom of the shaft 204 using mechanical fasteners 248, such as threaded bolts, for example, but is not limited thereto. A journal bearing shim 250 may be used to properly space the lower journal bearing 206 and keeper 244.

The lower portion of the shaft 204, as illustrated in FIG. 3, is slowly lowered into the lower journal housing. Then the remaining ⅓ of the cavity 218 defined by the lower journal housing 200 is filled with grease. The upper journal housing 202 can then be assembled to the lower journal housing 200 and fastened together using mechanical fasteners 252, such as threaded bolts, for example, but is not limited thereto.

It should be noted that due to the hardness of the grinding roll 180 in exemplary embodiments, the grinding roll 180 is spot drilled through set screw holes in a locknut 254 prior to installing set screws 256 in the set screw holes. It should also be noted that this final assembly uses a standard lock tab application 260 as in the conventional journal assembly 19 in FIG. 2.

The journal assembly 190 of FIGS. 3 and 4, in accordance with exemplary embodiments of the present invention, allows for larger capacity upper and lower journal bearings which provide longer grinding roll life and require fewer journal rebuilds over a same period of time. Use of the larger capacity upper and lower journal bearings provide lower bearing loads and contact stresses, and thus longer bearing service lives helping to ensure fewer journal rebuilds. The longer bearing service lives and fewer journal rebuilds facilitates attainment of the roll life goal extending to 82 months. The larger capacity upper and lower journal bearings incorporate the use of new or modified assembly components discussed above while retaining an original envelope. Customers can choose between newly manufactured shaft and journal housing components or remanufactured components with the above exemplary embodiments. Lastly, the seal assembly disposed at one terminal end of the upper journal housing incorporates proven seal technology and prevents the ingress of coal and contamination of the grease lubricant and journal assembly tapered roller bearings. In this manner, the seal assembly effectively prevents solid fuel dust, such as coal dust, for example, from penetrating into the journal assembly cavity. Lastly, exemplary embodiments of the journal assembly in accordance with the present invention permit the larger capacity tapered roller bearings of FIG. 3 to be retrofitted into the journal assembly of FIG. 2 while maintaining as many original parts as possible.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of extending the life of a journal bearing assembly in a solid fuel pulverizer, the method comprising:

removing a first lower journal bearing from a journal shaft and a lower bearing seat of a lower bearing housing configured to support a grinding roll in the pulverizer;

removing a first upper journal bearing from the shaft and an upper bearing seat of an upper bearing housing configured to be coupled to the lower bearing housing;

modifying the lower and upper bearing seats to provide modified lower and upper bearing seats;

modifying lower and upper shoulders on the journal shaft to receive second lower and upper journal bearings, respectively, while retaining an original diameter of the journal shaft under the second lower and upper journal bearings;

disposing the second lower and upper journal bearings on the modified lower and upper bearing seats, the second lower and upper journal bearings having at least one of an increased diameter and width than the first lower and upper journal bearings;

disposing a new journal bearing spacer between the second lower and upper journal bearings;

disposing a new journal bearing collar between the upper shoulder and the second upper journal bearing;

filling a cavity defined by the lower and upper journal housings with grease; and disposing a seal assembly between the shaft and one end of the upper journal housing opposite the lower journal housing to prevent the ingress of solid fuel into the cavity of the journal assembly.

2. The method of claim 1, wherein the seal assembly further comprises a wear sleeve disposed around the journal shaft and sealably engaged with an oil seal disposed in a counterbore of the upper journal housing.

3. The method of claim 2, wherein the seal assembly further comprises a retaining ring disposed in a groove in the upper journal housing to retain the oil seal in the counterbore.

4. The method of claim 2, further comprising:

heating the wear sleeve in an oil bath to a temperature of 250° F.;

disposing the wear sleeve over the shaft; and allowing the wear sleeve to cool to be fixedly attached to the shaft at a position corresponding to the oil seal.

5. The method of claim 2, wherein the seal is flexible allowing rotational motion of the upper journal housing relative to the stationary shaft, while maintaining a positive seal.

6. The method of claim 2, wherein the lower and upper shoulders of the shaft are modified corresponding to a modified width of the second lower and upper journal bearings.

7. The method of claim 1, wherein the second lower and upper journal bearings are larger tapered roller journal bearings each providing at least a 25% increase in dynamic radial capacity over the first lower and upper journal bearings.

8. The method of claim 1, wherein the lower and upper housings are new or modified existing lower and upper journal housings.

9. The method of claim 1, wherein the journal shaft is a new or modified existing journal shaft.

10. The method of claim 1, wherein the solid fuel is coal.

11. The method of claim 1, wherein modifying the lower and upper bearing seats includes increasing at least one of a diameter and a width of the lower and upper bearing seats corresponding to at least one of the increased diameter and width of the second lower and upper journal bearings.

* * * * *

UNITED STATES PATENT AND TRADEMARK OFFICE

CERTIFICATE OF CORRECTION

PATENT NO. : 8,087,172 B2
APPLICATION NO. : 12/239030
DATED : January 3, 2012
INVENTOR(S) : Lawrence S. Farris et al.

It is certified that error appears in the above-identified patent and that said Letters Patent is hereby corrected as shown below:

On first page, field (56), under "OTHER PUBLICATIONS", in column 2, line 2, Delete "Heinmann," and insert -- Heinemann, --, therefor.

In column 1, line 60, Delete "Retrofitable" and insert -- Retrofittable --, therefor.

Signed and Sealed this
Eighth Day of January, 2013

David J. Kappos

David J. Kappos
*Director of the United States Patent and Trademark Office*